US010587056B2

(12) United States Patent
Ambo

(10) Patent No.: US 10,587,056 B2
(45) Date of Patent: Mar. 10, 2020

(54) CRIMP CONNECTION TERMINAL AND PRODUCTION METHOD FOR SAME

(71) Applicant: DELTA PLUS CO., LTD., Mie (JP)

(72) Inventor: Tsugio Ambo, Saitama (JP)

(73) Assignee: DELTA PLUS CO., LTD., Mie (JP)

( * ) Notice: Subject to any disclaimer, the term of this patent is extended or adjusted under 35 U.S.C. 154(b) by 14 days.

(21) Appl. No.: 16/081,786

(22) PCT Filed: Mar. 1, 2017

(86) PCT No.: PCT/JP2017/008198
§ 371 (c)(1),
(2) Date: Aug. 31, 2018

(87) PCT Pub. No.: WO2017/150644
PCT Pub. Date: Sep. 8, 2017

(65) Prior Publication Data

US 2019/0044253 A1 Feb. 7, 2019

(30) Foreign Application Priority Data

Mar. 4, 2016 (JP) ..... 2016-042638
Oct. 28, 2016 (JP) ..... 2016-211688

(51) Int. Cl.
*H01R 4/10* (2006.01)
*H01R 4/18* (2006.01)
*H01R 43/16* (2006.01)

(52) U.S. Cl.
CPC ..... *H01R 4/188* (2013.01); *H01R 4/185* (2013.01); *H01R 43/16* (2013.01)

(58) Field of Classification Search
CPC .. H01R 4/18; H01R 4/183–185; H01R 4/188; H01R 43/16
USPC ..... 439/865, 866, 882, 883, 877
See application file for complete search history.

(56) References Cited

U.S. PATENT DOCUMENTS 3,892,459 A * 7/1975 Dittmann ..... H01R 4/188 439/442
9,595,770 B2 * 3/2017 Nagasaki ..... H01R 4/185
9,673,578 B1 * 6/2017 Lane ..... H01R 4/183
9,853,368 B2 * 12/2017 Myer ..... H01R 4/185
(Continued)

FOREIGN PATENT DOCUMENTS

JP 1976067321 U1 5/1976
JP 1981076269 U1 6/1981
JP 1982027668 U1 2/1982
(Continued)

*Primary Examiner* — Khiem M Nguyen
(74) *Attorney, Agent, or Firm* — Li & Cai Intellectual Property (USA) Office

(57) ABSTRACT

In the conductor crimping portion (3), side portions (3*a*, 3*b*) are folded into a bottom layer plate (3*c*) and a top layer plate (3*d*), and edges of the side portions (3*a*, 3*b*) are abutted against each other to form a joint (3*g*).

Additionally, three long groove-like punched long holes (3*i* to 3*k*), for example, are provided in an oblique direction with respect to a longitudinal direction of the crimp connection terminal in a bottom portion (3*h*) of the top layer plate (3*d*). A shallow round recessed portion (3*l*) is formed in the surface of the punched long hole (3*i*) by stamping. Edges (3*m*) of this recessed portion (3*l*) and new edges (3*n*') formed by edges (3*n*) of the punched long hole (3*i*), obtained by the punching, being pushed inward by the stamping are formed in two steps.

10 Claims, 6 Drawing Sheets

(56) References Cited

U.S. PATENT DOCUMENTS 9,972,920 B1 * 5/2018 Shimada ..... H01R 4/185

FOREIGN PATENT DOCUMENTS

| | | | |
|---|---|---|---|
| JP | 1992108864 | U1 | 9/1992 |
| JP | 2003338329 | A | 11/2003 |
| JP | 2009123597 | A | 6/2009 |
| JP | 2009129627 | A | 6/2009 |

* cited by examiner

【Fig.1】
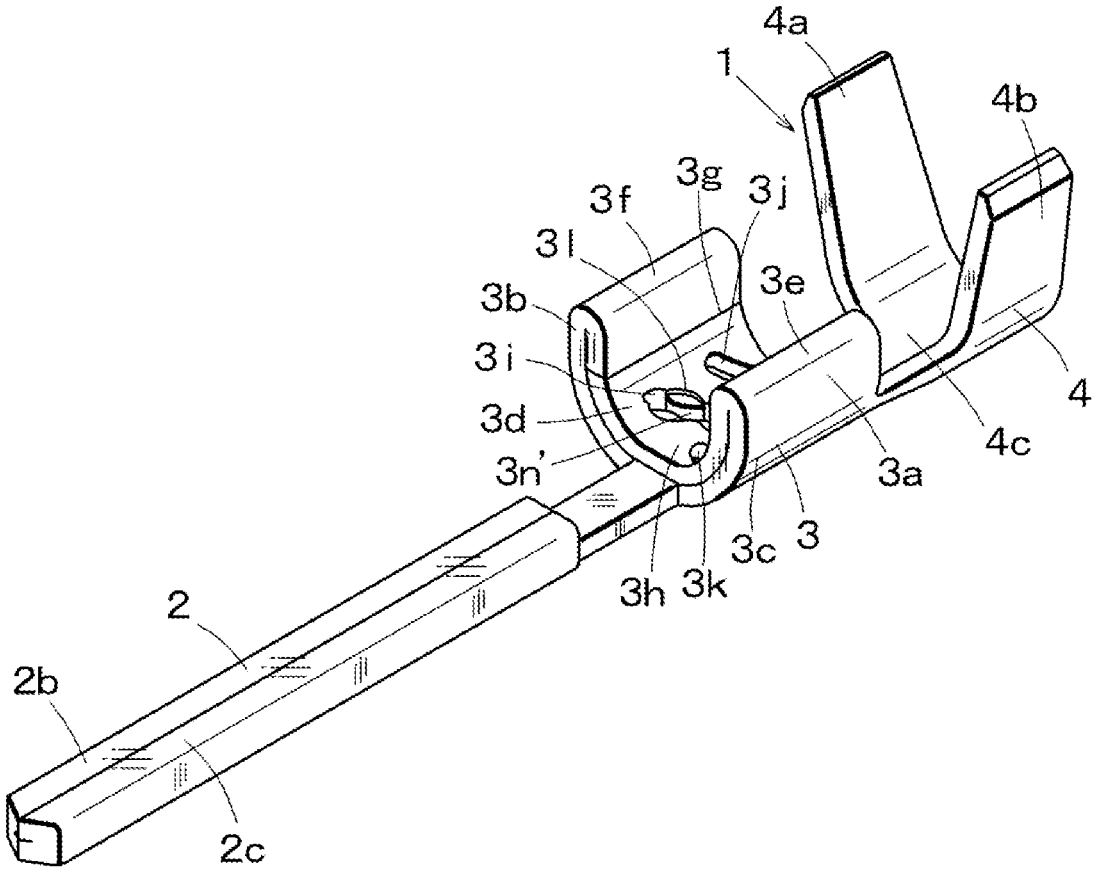

【Fig.2】
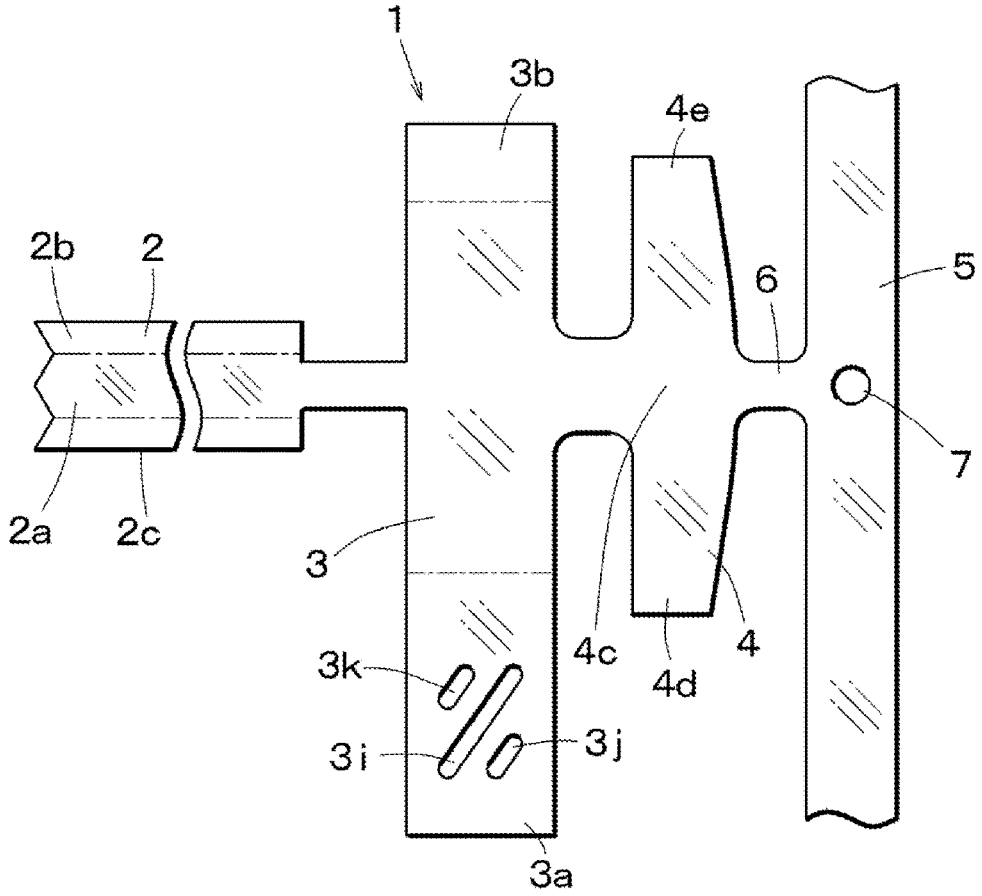
【Fig.3】
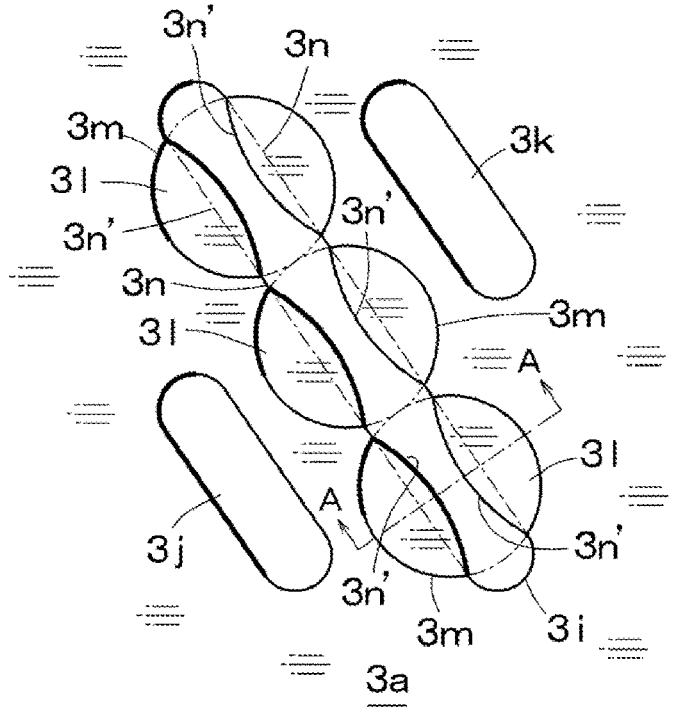

【Fig.4】
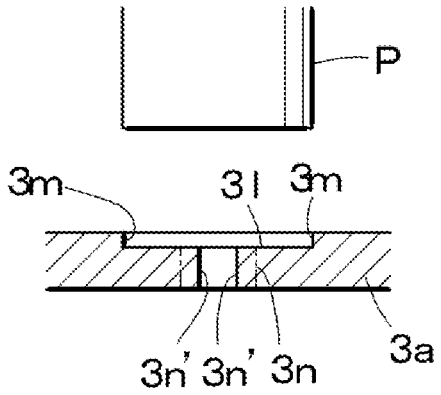
【Fig.5】
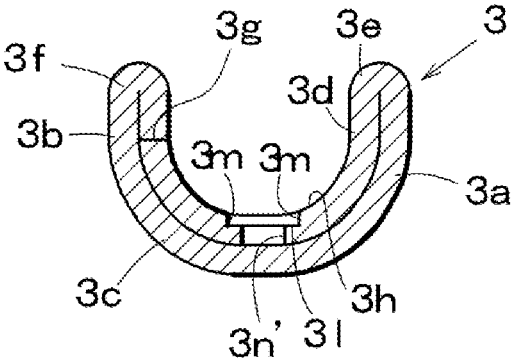

【Fig.6】
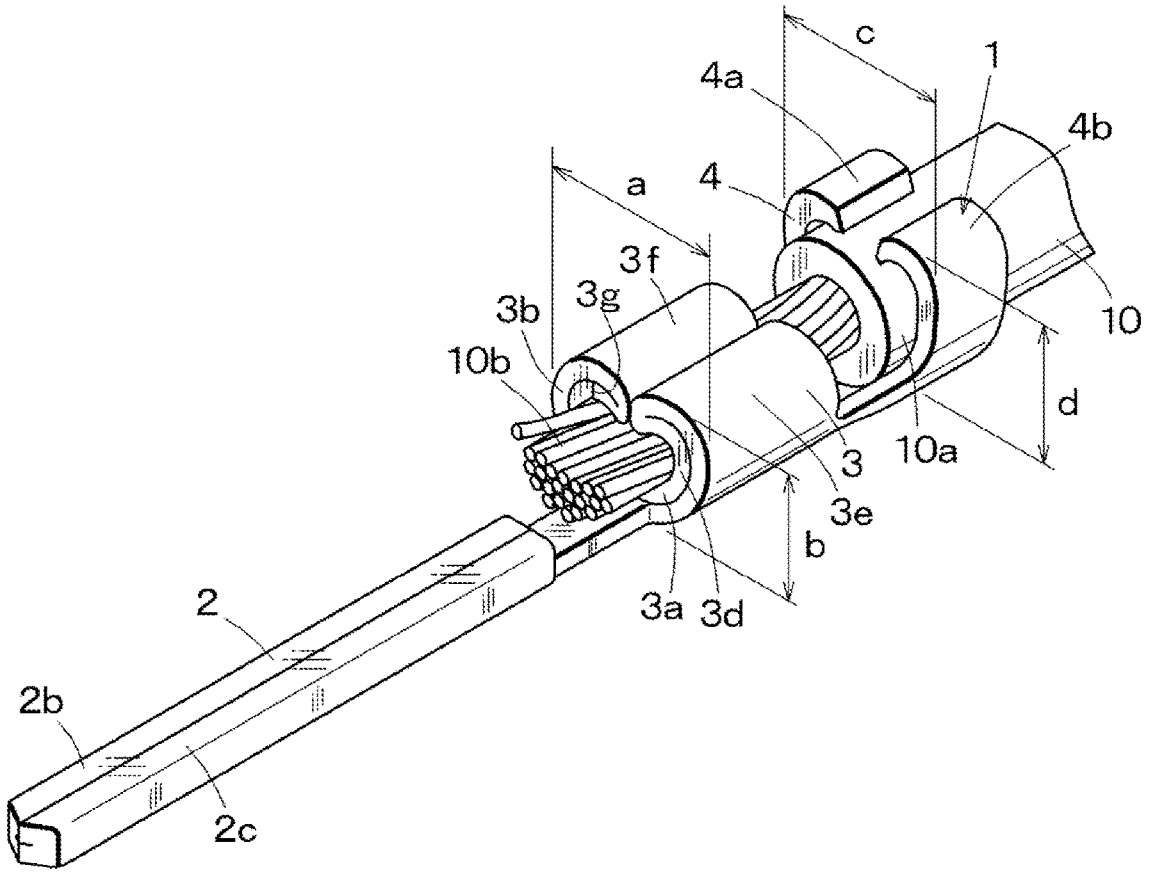

【Fig.7】
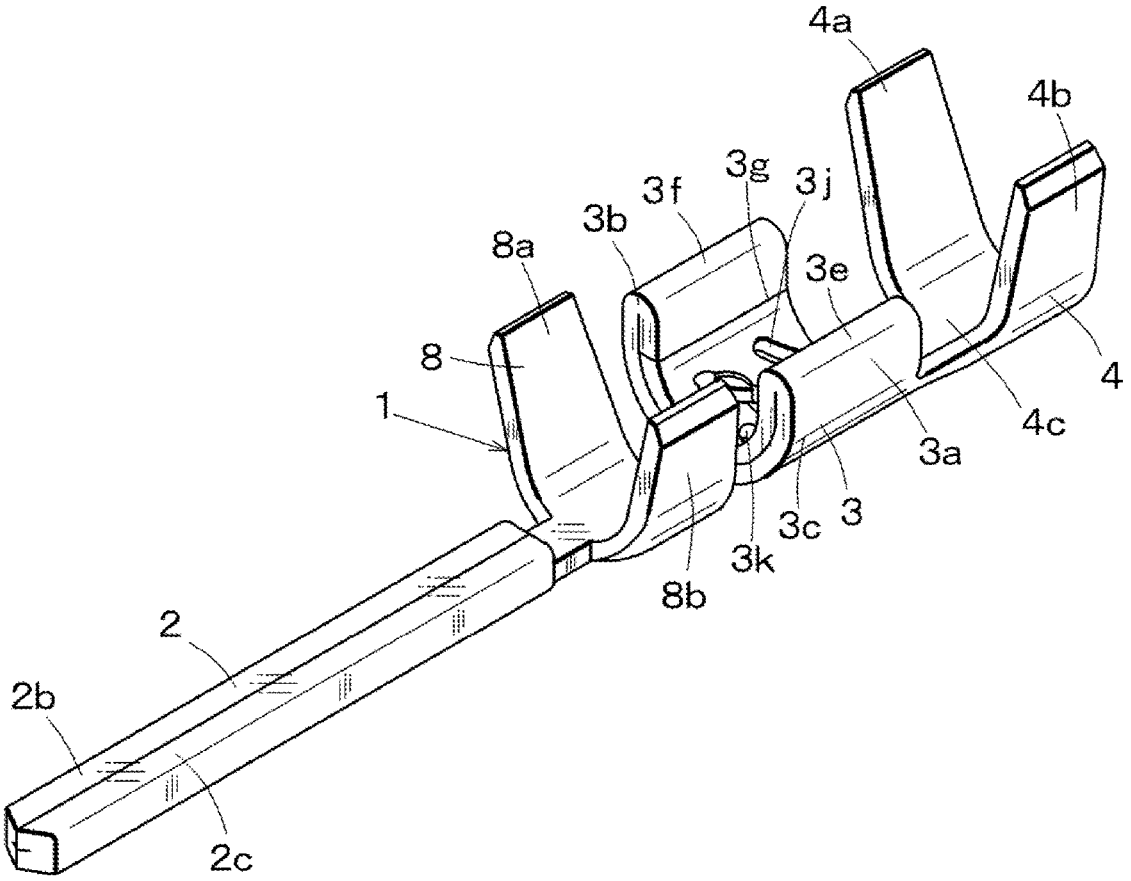
【Fig.8】
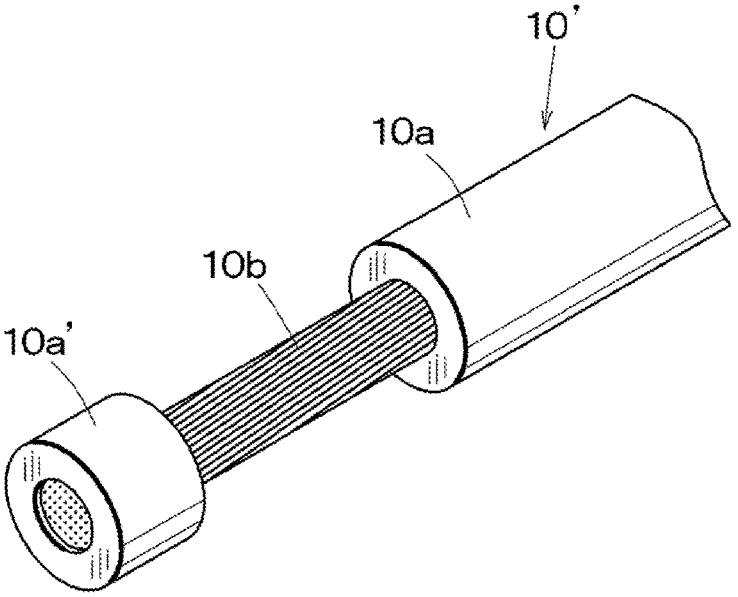

【Fig.9】
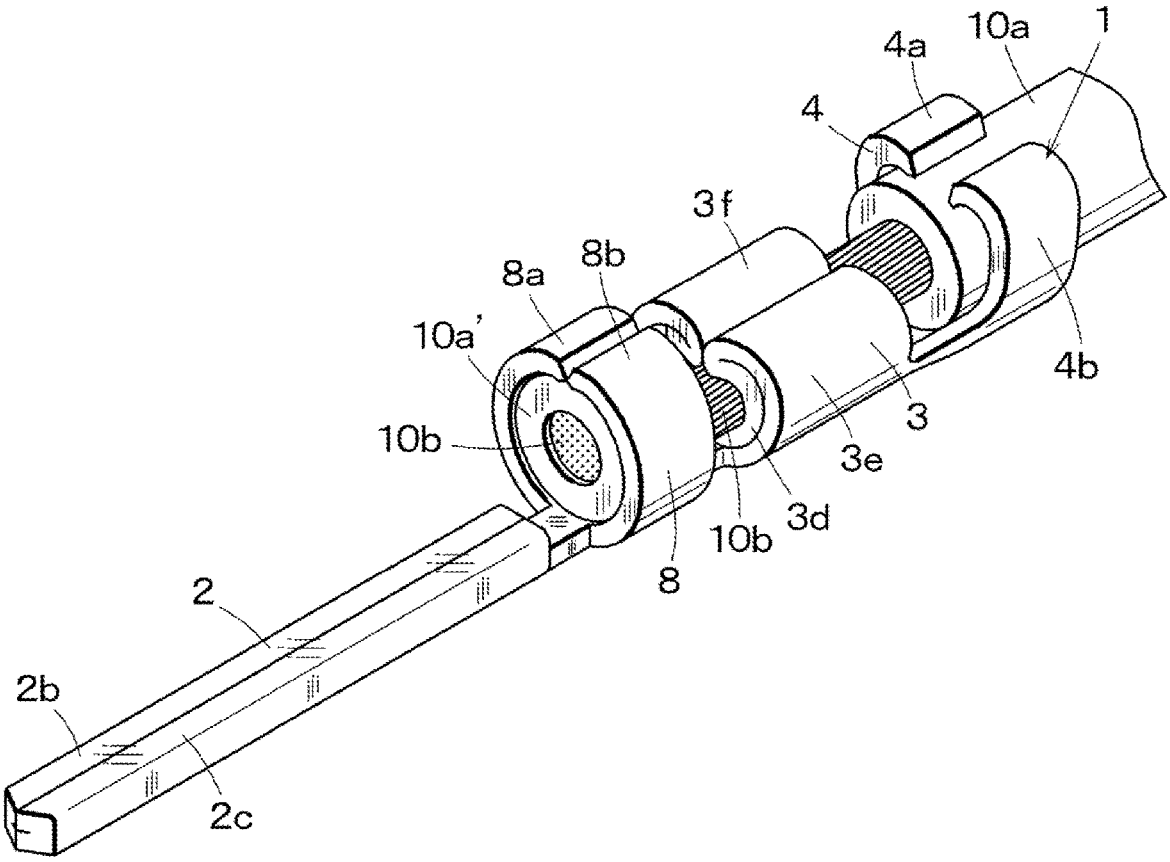

CRIMP CONNECTION TERMINAL AND PRODUCTION METHOD FOR SAME

BACKGROUND OF THE INVENTION

1. Field of the Invention

The present invention relates to a crimp connection terminal that connects an electric wire and, for example, is housed in a connector housing, and mates with a connection terminal of an opposite side connector; and a production method for the same.

2. Description of Related Art

With the miniaturization and integration of electronic circuits in recent years, a demand has arisen for smaller connection terminals used in the connections of circuits. For example, a rod-shaped insertion portion into an opposite side connection terminal is used that has a smaller diameter than the electrical wire that will be connected and that has an outer diameter of about 0.5 mm×0.5 mm.

CITATION LIST

Patent Literature

PTL 1: JP-A-2009-123597

SUMMARY OF THE INVENTION

Problems that the Invention is to Solve

With the miniaturization of connection terminals described above, the thickness of a conductive metal plate forming a connection terminal is decreased, the diameter of the electric wire is reduced, and the crimping force of a conductor crimping portion of the connection terminal securing a conductor portion of the electric wire is limited. Accordingly, trouble, that is, the conductor portion secured to the connection terminal falling out during use, is more likely to occur, and there is a concern about declines in electrical reliability.

As described in PTL 1, a countermeasure has been conceived in which a structure is formed in which two conductor crimping portions are stacked and grooves, holes, or the like are provided on an inner side of the conductor crimping portions to ensure the securing of the conductor portion.

However, this two-layer structure of conductor crimping portions also includes another plate-like member stacked at the bottom portion, which complicates the terminal production process and leads to an increase in the number of parts. Additionally, even when the grooves, holes, or the like are provided in the bottom portion, sufficient locking force cannot be obtained by forming the groove shapes, the holes, or the like.

An object of the present invention is to solve the problems described above, and provide a small crimp connection terminal whereby the conductor portion of the electric wire can be reliably crimped in the conductor crimping portion, and the reliability of the electrical connection can be ensured; and a production method for the same.

Means of Solving the Problems

A crimp connection terminal according to the invention for achieving the object described above is a crimp connection terminal including a conductor crimping portion that includes a pair of crimping tabs erected in a U-shape, wherein the crimping tabs are formed by punching, stamping, and folding one conductive metal plate, and a conductor portion of an electric wire is crimped and secured by the pair of crimping tabs. The conductor crimping portion has a stacked structure in which at least a bottom layer plate and a top layer plate are stacked, the top layer plate includes a punched long hole, a recessed portion is formed in an upper portion of the punched long hole, and an edge, namely edge portions of the punched long hole and the recessed portion, is formed in two steps.

A production method for the crimp connection terminal according to the invention is a production method for the crimp connection terminal including a punching step of punching one conductive metal plate to form a pair of side portions protruding outward in a conductor crimping portion, and punching a punched long hole in a first side portion that becomes a top layer plate of a bottom portion of the conductor crimping portion; a stamping step of stamping from a back side of the first side portion to form a recessed portion along the punched long hole; and a folding step of folding such that the first side in which the punched long hole is formed is folded back on a second side portion so as to become the top layer plate, and so that the recessed portion formed in an upper portion of the punched long hole is positioned on a front surface side of the top layer plate.

Advantageous Effects of the Invention

According to the crimp connection terminal and the production method thereof of the invention, the crimping tabs of the conductor crimping portion have a two-layer structure obtained by folding a conductive metal plate. Furthermore, the elongated groove-like punched long hole is provided in the top layer plate of the conductor crimping portion and a step is provided in the edge of the punched long hole due to the recessed portion. Therefore, the crimping force on the conductor portion of the electric wire is strengthened, and the edges of the punched long hole and the recessed portion bite into the conductor portion in two steps, thereby increasing conductivity and locking. As a result, electrical reliability is improved.

BRIEF DESCRIPTION OF THE DRAWINGS

FIG. 1 is a perspective view of a crimp connection terminal of a first embodiment;

FIG. 2 is a plan view of a conductive metal plate that has been punched to produce the crimp connection terminal;

FIG. 3 is an enlarged plan view of punched long holes, as viewed from the back side;

FIG. 4 is a cross-sectional view of a punched long hole, taken along line A-A of FIG. 3;

FIG. 5 is a cross-sectional view of a conductor crimping portion;

FIG. 6 is a perspective view of the crimp connection terminal of the first embodiment, illustrating a state in which an electric wire is secured;

FIG. 7 is a perspective view of a crimp connection terminal of a second embodiment;

FIG. 8 is a perspective view of the electric wire, illustrating a state in which a portion of an insulation cover portion remains; and FIG. 9 is a perspective view of the crimp connection terminal of the second embodiment, illustrating a state in which the electric wire is secured,

DETAILED DESCRIPTION OF THE PREFERRED EMBODIMENTS

The invention will be described in detail on the basis of the embodiments illustrated in the drawings.

First Embodiment

FIG. 1 is a perspective view of a crimp connection terminal of a first embodiment according to the invention. The crimp connection terminal is formed, for example, by punching, stamping, and folding one conductive metal plate 1 formed from thin brass and for which both surfaces have been plated with copper, tin, or the like. In one example, the crimp connection terminal is provided with a male connection portion 2 at the front, a conductor crimping portion 3 at the middle, and a cover crimping portion 4 at the back.

In the male connection portion 2, the conductive metal plate 1 is folded back to form a two-layer insertion end structure, but may also be a female connection portion or a male connection portion of a different form.

In the conductor crimping portion 3, a stacked structure is formed in which side portions 3*a*, 3*b* are folded back in part to form a bottom layer plate 3*c* and a top layer plate 3*d*, and a stacked pair of crimping tabs 3*e*, 3*f* facing diagonally upward are erected in a U-shape from both sides.

Moreover, the edges of the side portions 3*a*, 3*b* abut against each other in a rising portion of the top layer plate 3*d*, thereby forming a joint 3*g*. Additionally, for example, three elongated groove-like punched long holes 3*i* to 3*k* are formed, in an oblique direction with respect to a longitudinal direction of the crimp connection terminal, in a bottom portion 3*h* of the top layer plate 3*d*. The punched long hole 3*i* is subjected to further processing, but this will be described in detail later.

In the cover crimping portion 4, a pair of crimping tabs 4*a*, 4*b* facing diagonally upward are erected in a U-shape from both sides of a bottom portion 4*c*.

Actual crimp connection terminals may also include a stabilizer for stabilizing the posture of the crimp connection terminal within a connector housing, a locking portion for preventing pulling out of the crimp connection terminal in a forward-backward direction, and the like, but illustrations of these known mechanisms are omitted in the drawings.

FIG. 2 is a plan view illustrating a state in which the conductive metal plate 1 having a thickness of 0.15 mm is punched but prior to being molded into the crimp connection terminal illustrated in FIG. 1. The dot-dash lines are fold-in lines for folding in a forming press (described later). In the male connection portion 2, to form an insertion end of the double structure, foldback tabs 2*b*, 2*c* that become a top plate are formed on both sides of a bottom portion 2*a* that becomes a bottom plate.

Additionally, in the conductor crimping portion 3, the side portions 3*a*, 3*b* that become the bottom layer plate 3*c* and the top layer plate 3*d* each protrude outward from both sides with differing lengths and, for example, the three elongated groove-like punched long holes 3*i* to 3*k* are punched in the oblique direction in the longer side portion 3*a*. The punched long holes 3*i* to 3*k* provided in the side portion 3*a* are configured so as to be positioned on the bottom portion 3*h* on the top layer plate 3*d* side in a state in which when folded back and stacked on the other side portion 3*b* in a folding step. For example, the punched long hole 3*i* is formed long and the punched long holes 3*j*, 3*k* on both sides are formed shorter than the punched long hole 3*i* to allow for disposal in the oblique direction.

FIG. 3 is an enlarged plan view of the punched long holes 3*i* to 3*k*, as viewed from the back side, and FIG. 4 is a cross-sectional view taken along line A-A of FIG. 3. The conductive metal plate 1, in which the punched long holes illustrated in FIG. 2 have been punched, is stamped from the back surface side of the side portion 3*a* along the punched long hole 3*i* using, for example, three juxtaposed round punches P. Specifically, a flat metal plate is placed against the front surface side of the side portion 3*a* and, when stamping is performed from the back surface side using, for example, the three round punches P, three round recessed portions 3*l* are formed adjacently, straddling the punched long hole 3*i*, and edges 3*m*, which are edge portions of the recessed portions 3*l*, are formed. Note that the number of the recessed portions 3*l* is not limited to three, and the recessed portions 3*l* need not be round. For example, the recessed portions 3*l* may be rectangular.

As a result of the forging by stamping, the conventional edge portion of the punched long hole 3*i*, namely an edge 3*n*, protrudes in an arc shape into the punched long hole 3*i*, and a total of six new arc-shaped edges 3*n*' are formed on both sides of the inner edge at positions lower than the surface of the conductive metal plate 1. In reality, the original shapes of the edges 3*n*' are not necessarily maintained, but the sharp shape of the corner portions of the edge 3*n* are substantially maintained as-is. Thus, the edges 3*n*' of the punched long hole 3*i* and the edges 3*m* of the upper recessed portions 3*l* of the punched long hole 3*i* are formed in two steps as illustrated in FIG. 4.

Note that, while there is no particular problem with the edges of the other short punched long holes 3*j*, 3*k* not being subjected to the stamping processing, the recessed portions 3*l* may be provided in the same manner as in the punched long hole 3*i*. Additionally, the number of the punched long holes 3*i* to 3*k* is not limited to three and, provided that there is at least one, any number may be used. However, there must be a punched long hole provided with the recessed portions 3*l*.

In an example of dimensional sizes of the punched long hole 3*i* and the like, a length of the punched long hole 3*i* is 1.8 mm, a width is 0.2 mm, a diameter of the round recessed portions 3*l* is 0.5 mm, a depth is 0.04 mm, and a width of the largest section of the portion where the edges 3*n*' protrude into the punched long hole 3*i* is 0.05 mm.

In FIG. 2, in the cover crimping portion 4, side portions 4*d*, 4*e* that become the crimping tabs 4*a*, 4*b* protrude on both sides of the bottom portion 4*c*. A feed tab 5 that couples punched crimp connection terminals is provided farther behind the cover crimping portion 4, and the cover crimping portion 4 of each crimp connection terminal is coupled with the feed tab 5 by a coupling tab 6. Note that a pilot hole 7 is used to transport the crimp connection terminal during molding steps.

The conductive metal plate 1 that has been punched and stamped as described above is, for example, chamfered and surface treated, as necessary and, thereafter, while being transported by the feed tab 5, is successively folded in various molding steps by a forming press and molded into the crimp connection terminal illustrated in FIG. 1.

FIG. 5 is a cross-sectional view of the conductor crimping portion 3 at this time. The side portions 3*a*, 3*b* of the conductor crimping portion 3 are folded back, molded into the bottom layer plate 3*c* and the top layer plate 3*d*, and the recessed portions 3*l* formed in the upper portion of the punched long hole 3*i* are positioned on the front surface side of the top layer plate 3*d*.

FIG. 6 is a perspective view illustrating a state in which an electric wire 10 is crimped and secured in the crimp connection terminal illustrated in FIG. 1 by an electric wire crimping device. An insulation cover portion 10*a* of the electric wire 10 has been stripped off, and a conductor portion 10*b* obtained by twisting a plurality of core wires together is crimp locked so as to be enveloped by the pair of crimping tabs 3*e*, 3*f* in the conductor crimping portion 3. At this time, the conductor crimping portion 3 is the stacked structure of the bottom layer plate 3*c* and the top layer plate 3*d* obtained by folding the conductive metal plates 1 and, as such, securing is possible due to strong crimping force being exerted on the conductor portion 10*b*.

The electric wire 10 that is used is a so-called fiber electric wire in which core wires made from aramid fiber filaments having a diameter of about 20 μm are subjected to copper plating at a thickness of about 1 μm, and 130 of these core wires are twisted together. A diameter of the conductor portion 10*b* of this electric wire 10 is about 0.3 mm, and an outer diameter of the electric wire 10 including the insulation cover portion 10*a* is about 0.7 to 0.8 mm.

Thus, the conductor portion 10*b* will be bitten into in two steps even though the core wires of the conductor portion 10*b* are extremely thin and the depths of the edges 3*m* of the recessed portions 3*l* formed in the vicinity of the punched long hole 3*i* provided in the top layer plate 3*d* of the conductor portion 10*b* and the protruding edges 3*n*' of the punched long hole 3*i* are small. Moreover, along with the biting by the edges of the punched long holes 3*j*, 3*i*, strong locking force against the pulling out of the conductor portion 10*b* is obtained. Furthermore, creeping distance along the edges increases since the edges 3*m* of the recessed portions 3*l* are arc-shaped, and, as such, the place where the core wires of the conductor portion 10*b* are bitten is lengthened and the locking force increases.

At the same time, even if an insulating film such as an oxide or a sulfide has formed on the surface of the core wires of the conductor portion 10*b*, the insulating film will be destroyed by the biting of the edges 3*m* of the recessed portions 3*l*, the edges 3*n*' of the punched long hole 3*i* and the edges of the punched long holes 3*j* and 3*k*, and the conductivity between the conductor crimping portion 3 and the conductor portion 10*b* will be good.

Note that the core wires of the conductor portion 10*b* are twisted in a helical direction and, as such, the punched long holes 3*i* to 3*k* are formed in an oblique direction so as to intersect the core wires, thereby increasing the effectiveness of the biting by the edges of the punched long holes 3*i* to 3*k*.

In the cover crimping portion 4, the outside of the insulation cover portion 10*a* of the electric wire 10 is crimped by the pair of crimping tabs 4*a*, 4*b* and, as such, the electric wire 10 is strongly secured, thereby enabling resistance against pulling out forces acting on the electric wire 10.

Note that, in this embodiment, the joint 3*g* between the side portions 3*a*, 3*b* of the conductor crimping portion 3 is provided on the top layer plate 3*d* side of the one crimping tab 3*f*, and it is preferable that the joint 3*g* is provided on the top layer plate 3*d* rather than being provided on the bottom layer plate 3*c* because this position will be in the direction in which the space of the joint 3*g* narrows when crimping.

Additionally, if the joint 3*g* is provided on the top layer plate 3*d* and a slight space is provided, edge portions of this joint 3*g* will also bite into the conductor portion 10*b*, thereby further promoting the locking force. Note that the joint 3*g* need not necessarily be oriented in the longitudinal direction and, by punching the edges of the side portions 3*a*, 3*b* in the oblique direction, the joint 3*g* may be formed so as to be inclined from the longitudinal direction.

Note that, as illustrative dimensions of the various components of the crimp connection terminal after the electric wire 10 is crimped, as illustrated in FIG. 6, a width a of the conductor crimping portion 3 is 1.0 mm, a height b is 0.75 mm, a width c of the cover crimping portion 4 is 1.2 mm and a height d is 1.45 mm.

In the first embodiment described above, the conductor crimping portion 3 is a two-layer structure, but, as necessary, an intermediate layer plate may be provided between the bottom layer plate 3*c* and the top layer plate 3*d* by folding back, or a separate intermediate layer plate may be disposed to form a three-layer structure and further increase the crimping force.

Second Embodiment

FIG. 7 is a perspective view of a crimp connection terminal of a second embodiment. In addition to the configuration of the crimp connection terminal of the first embodiment, a conductor end crimping portion 8 made from crimping tabs 8*a*, 8*b* is further provided on the male connection portion 2 side of the conductor crimping portion 3. This conductor end crimping portion 8 is erected in a U-shape facing diagonally upward by the conductive metal plate being punched and folded, the same as the cover crimping portion 4.

For example, when using, as the conductor portion of the electric wire, a fiber electric wire made by twisting together a plurality of conducting wires that have extremely small diameters or the like, the conductor portion may unravel when the insulation cover portion is pulled off and the conductor portion is exposed when crimping to the crimp connection terminal, thereby making the crimping by the conductor crimping portion 3 difficult.

Therefore, as illustrated in FIG. 8, the insulation cover portion 10*a* is pulled off from the tip of an electric wire 10' up to a predetermined position and, also, the protruding tip is removed to leave one end at the tip of the conductor portion 10*b* as a remaining portion 10*a*', thereby preventing the conductor portion 10*b* from unraveling.

The conductor portion 10*b* of the electric wire 10' processed in this manner does not unravel and, as such, it is possible to perform normal crimping by the conductor crimping portion 3. Additionally, at this time, as illustrated in FIG. 9, the remaining portion 10*a*' of the electric wire 10' is crimped together with the conductor portion 10*b* so as to surround it by the conductor end crimping portion 8.

Note that when the electric wire 10' illustrated in FIG. 8 in which the remaining portion 10*a*' remains is used, the conductor portion 10*b* will not unravel when crimping. However, if allowed to sit without crimping the remaining portion 10*a*', during later use of the crimp connection terminal, the remaining portion 10*a*' may fall off the conductor portion 10*b* and move, which will result in a high possibility of electrical failure occurring. Therefore, it is preferable that the remaining portion 10*a*' be crimped by the conductor end crimping portion 8 together with the conductor portion 10*b*, thereby securing the remaining portion 10*a*', as illustrated in FIG. 9.

DESCRIPTION OF REFERENCE NUMERALS AND SIGNS

1 Conductive metal plate
2 Male connection portion
3 Conductor crimping portion
3*a*, 3*b* Side portion
3*c* Bottom layer plate
3*d* Top layer plate
3*e*, 3*f* Crimping tabs
3*g* Joint
3*h* Bottom portion
3*i* to 3*k* Punched long hole
3*l* recessed portion
3*m*, 3*n*, 3*n*' Edge

4 Cover crimping portion
8 Conductor end crimping portion
10, 10' Electric wire
10*a* Insulation cover portion
10*a'* Remaining portion
10*b* Conductor portion

What is claimed is:

1. A crimp connection terminal, characterized by comprising:

a conductor crimping portion including a pair of crimping tabs erected in a U-shape, wherein the crimping tabs are formed by punching, stamping, and folding one conductive metal plate, and a conductor portion of an electric wire is crimped and secured by the pair of crimping tabs; wherein the conductor crimping portion has a stacked structure in which at least a bottom layer plate and a top layer plate are stacked;

the top layer plate includes a punched long hole;

a recessed portion is formed in an upper portion of the punched long hole; and an edge, namely edge portions of the punched long hole and the recessed portion, is formed in two steps.

2. The crimp connection terminal according to claim 1, characterized in that the recessed portion is formed straddling the punched long hole.

3. The crimp connection terminal according to claim 1, characterized in that:

a shape of the recessed portion is round; and a plurality of the recessed portions are formed adjacent to each other.

4. The crimp connection terminal according to claim 1, characterized in that:

the bottom layer plate and the top layer plate of the conductor crimping portion are formed by folding two sides formed by punching the conductive metal plate; and a joint resulting from the two sides abutting against each other is provided in the top layer plate.

5. The crimp connection terminal according to claim 1, characterized in that the conductor portion of the electric wire is a plurality of core wires that have been twisted together.

6. The crimp connection terminal according to claim 5, characterized in that the punched long hole is disposed in an oblique direction so as to intersect a helical direction in which the core wires of the conductor portion are twisted.

7. The crimp connection terminal according to claim 1, characterized in that a cover crimping portion crimping and securing an insulation cover portion of an electric wire by a pair of crimping tabs erected in a U-shape is provided behind the conductor crimping portion.

8. The crimp connection terminal according to claim 1, characterized in that a connection portion that connects to another connection terminal is provided in front of the conductor crimping portion.

9. The crimp connection terminal according to claim 8, characterized by further comprising:

a conductor end crimping portion that crimps a remaining portion separated from an end of the insulation cover portion and remained at a tip of the conductor portion; wherein the conductor end crimping portion comprises a pair of crimping tabs erected in a U-shape between the conductor crimping portion and the connection portion, and crimps and secures the conductor portion and the remaining portion.

10. A production method for a crimp connection terminal, characterized by comprising:

a punching step of punching one conductive metal plate to form a pair of side portions protruding outward on a conductor crimping portion, and punching a punched long hole in a first side portion that becomes a top layer plate of a bottom portion of the conductor crimping portion;

a stamping step of stamping from a back side of the first side portion to form a recessed portion along the punched long hole; and a folding step of folding such that the first side portion in which the punched long hole is formed is folded back on a second side portion so as to become the top layer plate, and so that the recessed portion formed in an upper portion of the punched long hole is positioned on a front surface side of the top layer plate.

* * * * *